US005690243A

United States Patent [19]

Molinaro

[11] Patent Number: 5,690,243

[45] Date of Patent: Nov. 25, 1997

[54] SNAP ON TWIST OFF TAMPER INDICATING FLEXIBLE CAP AND NECK CONFIGURATION

[75] Inventor: Luca Molinaro, New Castle, Pa.

[73] Assignee: Portola Packaging, Inc., San Jose, Calif.

[21] Appl. No.: 654,553

[22] Filed: May 22, 1996

Related U.S. Application Data

[60] Division of Ser. No. 150,356, Nov. 4, 1993, Pat. No. 5,560,504, and a continuation-in-part of Ser. No. 36,277, Mar. 24, 1993, Pat. No. 5,307,946.

[51] Int. Cl.[6] ..... B65D 41/34

[52] U.S. Cl. ..... 215/329; 215/256; 215/318; 215/330; 215/288; 215/296

[58] Field of Search ..... 215/256, 329, 215/308, 337, 344

[56] References Cited

U.S. PATENT DOCUMENTS

| | | | |
|---|---|---|---|
| 4,298,129 | 11/1981 | Stull | 215/224 |
| 4,354,609 | 10/1982 | Hidding | 215/252 |
| 4,625,875 | 12/1986 | Carr | 215/232 |
| 4,630,761 | 12/1986 | Thomson | 222/551 |
| 4,834,252 | 5/1989 | Crisci | 215/256 |
| 5,060,813 | 10/1991 | Gollasch | 215/329 |
| 5,307,746 | 5/1994 | Molinaro | 215/256 |
| 5,307,945 | 5/1994 | Hidding et al. | 215/256 |

FOREIGN PATENT DOCUMENTS

| | | |
|---|---|---|
| 0118267B | 10/1986 | European Pat. Off. . |
| 2114553 | 8/1983 | United Kingdom . |

*Primary Examiner*—Joseph M. Moy

*Attorney, Agent, or Firm*—Flehr, Hohbach, Test, Albritton, & Herbert

[57] ABSTRACT

A novel snap on pull off tamper indicating cap and neck configuration for containers, the cap having a top with an annular depending wall on its peripheral edge and seven circumferentially spaced continuous spiral thread configurations on the inner surface of the annular depending wall. A removable tear skirt with continuous opposing groups of ratchet teeth on its inner surface depends from the outer peripheral edge of an out-turned flange on said annular wall. An inturned continuous annular rib on said annular depending wall engages on and deforms the neck configuration. The tear skirt is joined to the flange with multiple frangible connections from the ratchet teeth, a pull tab on the tear skirt with frangible lines requiring removal of the tab and tear skirt from the cap before the cap can be rotated. The novel construction also enabling lead-in ends of the seven circumferentially spaced thread patterns on the depending wall to immediately engage the neck configuration having registering circumferentially spaced continuous spiral thread configurations on its exterior thereof.

13 Claims, 2 Drawing Sheets

SNAP ON TWIST OFF TAMPER INDICATING FLEXIBLE CAP AND NECK CONFIGURATION

This is a division, of application Ser. No. 08/150,356 filed Nov. 4, 1993. Now U.S. Pat. No. 5,560,504 a continuation in part of Ser. No. 08/036,277, filed Mar. 24, 1993. Now U.S. Pat. No. 5,307,946.

BACKGROUND OF THE INVENTION

1. Technical Field

This invention relates to tamper indicating caps and registering conforming container neck finishes on blow molded plastic jugs which are widely used in the dairy industry and others for expendable packaging of dairy products and the like.

2. Description of Prior Art

Prior art devices of this type have relied on a variety of different cap and neck finish configurations. See for example a first group of U.S. Pat. Nos. 3,980,195, 4,354,609, 4,402,415, 4,561,553 and a second group of U.S. Pat. Nos; 2,163,711, 2,162,712, 3,650,428, 4,418,828, 4,497,765, 4,534,480, 3,504,818, a third group of configurations, U.S. Pat. Nos. 1,443,682, 4,852,774, 5,004,114 and U.S. Pat. Nos. 3,980,195, 4,298,129, 4,476,987, 4,589,561.

In the first and second group of the above referred to U.S. patents, they are directed towards individual neck and cap spiral thread configurations and have the common fault of requiring selective testing rotation of the cap on the threaded neck of the container before the single thread portions engage.

The patents in the third group are directed towards selective multiple thread configurations with specific reference now to U.S. Pat. No. 1,443,682, a thread pattern is disclosed having non-overlapping thread elements.

U.S. Pat. No. 4,852,774 is directed towards a container cap having a plurality of short arcuate inner threads adjacent the outer end of the cap.

U.S. Pat. No. 5,004,114 shows only the container with a neck finish having a plurality of inner engaging twist threads.

The final group of patents noted above are as follows.

In U.S. Pat. No. 3,980,195 a tamper proof closure is disclosed having a top portion with a depending annular wall having threads formed therein. A split tamper proof ring is secured to the cap by multiple severable locations on respective projections from the interior of the tamper proof ring.

U. S. Pat. No. 4,298,129 discloses a child proof snap on twist off safety cap and container having a contoured neck portion defining a sealing bead against the container, a plurality of annularly spaced nibs projecting inwardly from said cap.

U.S. Pat. No. 4,476,987 again shows a tamper evident cap having a series of annularly spaced nibs extending inwardly for engagement against the neck of a container onto which it is placed.

U.S. Pat. No. 4,561,553 is directed towards a snap on twist off tamper proof closure for containers that uses a limited thread configuration and an internal annular flange on the depending wall of the cap to engage the neck finish of the container. The annular flange forms a first fastening configuration by engaging a shallow groove within the neck finish.

U.S. Pat. No. 4,589,561 similar to U.S. Patent ending in 553 which again shows an inturned annular flange on the depending wall of the cap that engages a shallow groove in the exterior surface of the neck finish forming a first fastening configuration.

In U.S. Pat. No. 4,770,306 a location of bridges on a tamper blank styled closure can be seen having a tamper indicating band on the closure with a series of annularly spaced nibs positioned on the depending cap wall above the first threaded portion.

Finally, U.S. Pat. No. 5,213,224 is directed to a snap on screw off cap and container neck in which a circular rib is shown depending from the cap top adjacent to a plug forming a seal with the top of the neck finish.

SUMMARY OF THE INVENTION

A push on pull off tamper indicating flexible cap for containers such as blow molded jugs with the appropriate neck configuration takes the form of a cap portion having a top and an annular depending wall on its peripheral edge radially spaced from an annular sealing flange depending from the top of the cap. There are multiple continuous thread patterns on the inner surface of the annular depending wall with an inturned annular flange adjacent the top for deflecting engagement on the neck finish and an out-turned flange on the lower edge of the annular depending wall which has a plurality of frangible integral connections from the wall to continuous ratchet teeth group configurations on a tear skirt. The neck configuration has spaced areas of continuous reverse groups of ratchet teeth configurations for registration with the ratchet teeth groups on the inner surface of the tear skirt. A pull tab attached to the tear skirt adjacent a vertical positioned weakened line requires the tear skirt with its continuous ratchet teeth group configurations and inturned flange to be removed before removal of the remaining screw cap can be achieved.

DESCRIPTION OF THE PREFERRED EMBODIMENT

Figure 1:
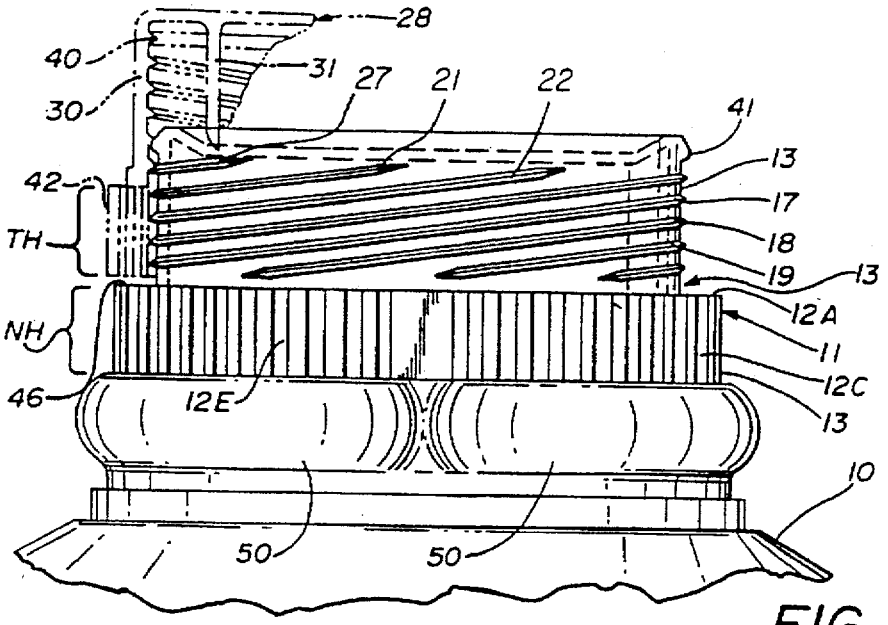
FIG. 1 is a side elevation of the finish on the neck of the blow molded jug with a cap portion partially engaged thereon shown in broken lines.

By referring to the drawings in FIGS. 1–4 in particular it will be seen that a portion of a blow molded jug or the like 10 has a neck 11 of a first diameter including at least four groups of vertically fastening configurations 12 spaced circumferentially thereon which define a shoulder 12A. The neck of the container above the shoulder 12A is a cylindrical portion 13 with a plurality, preferably 7, horizontally and vertically spaced continuous annular threads 14–20 with the upper horizontally spaced ends of the spiral threads being indicated by the numerals 21–27.

Figure 2:
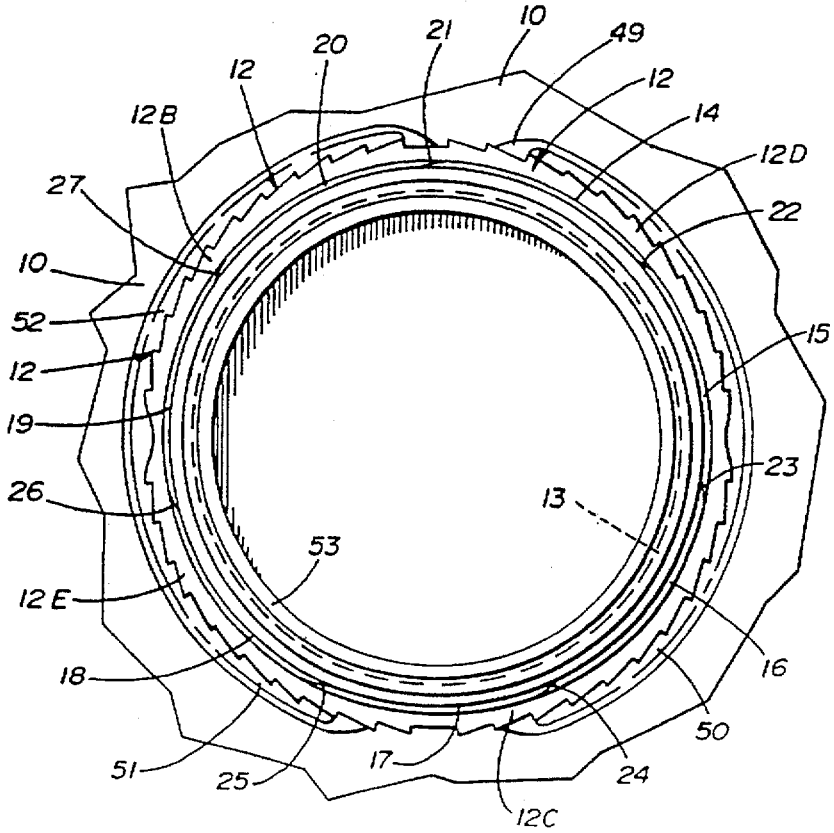
FIG. 2 is a top plan view of the neck finish shown in FIG. 1.

Still referring, it FIGS. 1 and 2 of the drawings, it will be seen that each of the vertically and horizontally spaced continuous annular spiral threads 14–20 extend circumferentially around the neck portion before terminating on the cylindrical neck portion 13 in spaced relation to the upper surface of the portion 11 of the neck finish.

It will be seen that the lead in ends 21–27 of the seven circumferentially and vertically spaced continuous annular spiral threads 14–20 respectively and wherein the lead in ends as shown in FIG. 2 of the drawings are spaced circumferentially with respect to one another continuously around the neck finish of the cylindrical neck portion 13.

Additionally in FIG. 2, the vertical fastening configurations 12 may be seen to comprise four groups of ratchet teeth of like pairs which are preferably positioned on the opposing side of the neck portion 13. Opposing like pairs 12B and 12C and 12D and 12E have opposite ratchet teeth direction and group pairs 12D and 12E are of a lesser diameter than said remaining group pairs.

Figure 3:
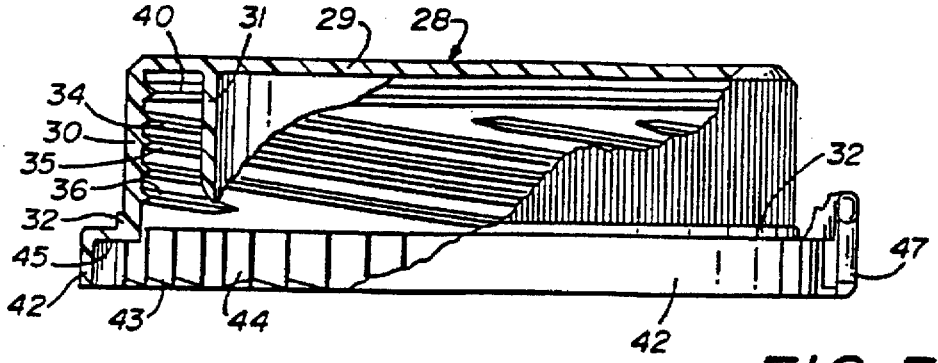
FIG. 3 is a partial cross-sectional view of the push on pull off cap with parts broken away.
Figure 4:
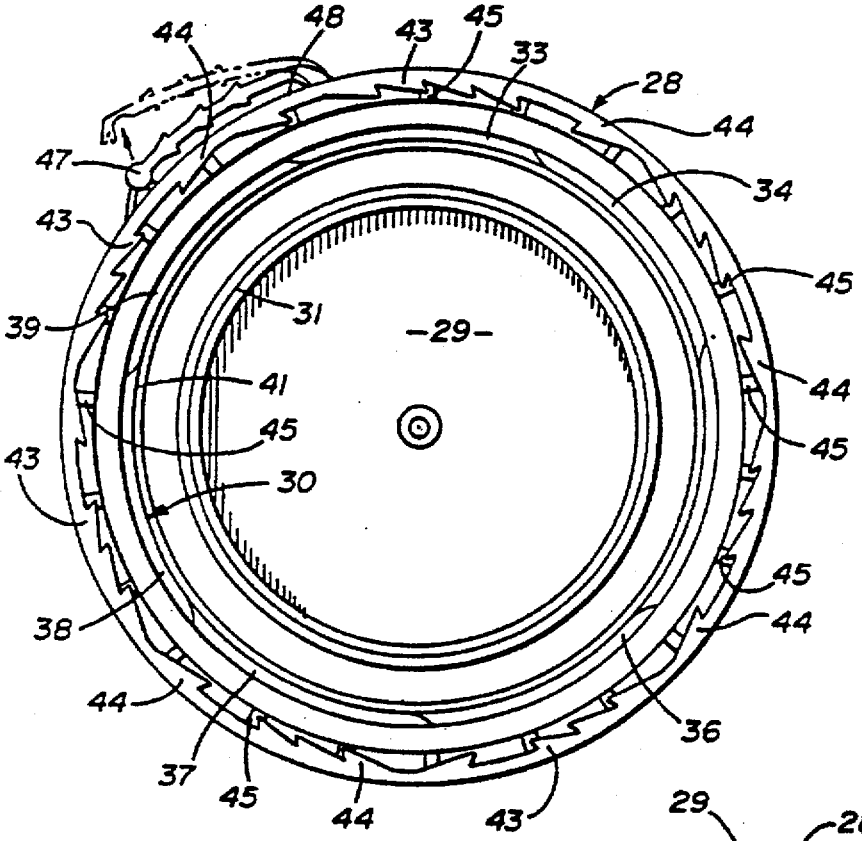
FIG. 4 is a bottom view of the push on pull off flexible cap of the invention illustrating the novel continuous ratchet teeth group configurations on the tear skirt.

Referring to FIGS. 3 and 4, it will be seen that a cap 28 comprises a top portion 29 having an annular depending wall 30 integrally joined to the peripheral edge of the top portion 29. The cap 28 is provided with a downturned annular sealing flange 31 depending from the bottom of the top portion 29, and the bottom edge of the depending annular wall 30 comprises a narrow out-turned rib 32.

The annular depending wall 30 has a plurality of continuous annular spiral cap threads 33–39 and a single inturned annular flange 40 that extend from the inner surface of the depending wall 30 spaced in adjacent relation to the bottom of the top portion 29 and vertically spaced above the respective threads 33–39 as hereinbefore described.

Figure 5:
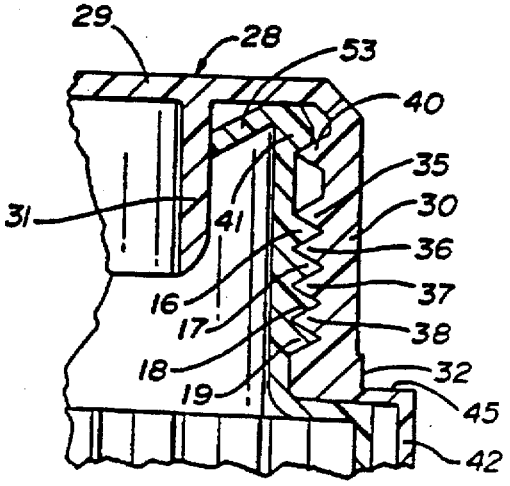
FIG. 5 is a cross-section of a portion of the cap on the neck finish of the invention.

Referring to FIG. 5 of the drawings, a portion of the cap 28 can be seen engaged on a portion of the neck portion 13 of the container 10 in which the respective multiple spiral cap threads 33–39 are in registration with the annular spiral threads 14–20 of the neck finish 13.

The single inturned annular flange 40 is in deformable registration under an continuous annular out-turned bead 41 on said neck portion 13 above the respective engaged spiral threads. The annular flange 40 of the cap 28 deforms and contours the respective upper neck portion 13 into a true circular shape by forcing same against the hereinbefore described sealing flange 31 upon placement and sealing of the cap thereon. The rounding off of the uppermost neck portion 13 defines a seal between the cap 28 and the neck finish 11 by sealing same against the sealing flange 31 as well as additional seal between the flange 40 and the neck finish bead 41 as hereinbefore described.

The cap 28 has a tear skirt 42 of a slightly larger diameter than the out-turned rib 32 and is formed with its inner surface having groups of continuous multiple ratchet teeth configuration 43 thereabout with annular spaced reversed ratchet teeth 44 therebetween. A series of connecting members 45 extend from below the out-turned rib 32 to the respective ratchet teeth 43 and 44 by which the tear skirt 42 is integrally attached to the lower peripheral edge of the narrow out-turned rib 32.

It will be apparent that due to the nature of the multiple horizontally and vertically continuous annular spiral spaced threads 14–20 positioned on the neck 11 of the container 10 that the effective initial registration point of the respective cap threads 33–39 will be achieved as the cap is pushed downwardly onto the neck portion 13 in the initial snapping (i.e. sealing of the cap with the neck). As the cap descends vertically onto the neck portion 13, the inner engaging multiple thread portions, hereinbefore described, provide for three distinct "snaps" of engagement. Once the quote "snaps" have been achieved an effective closure seal is achieved between both the annular sealing flange 31 and inturned bead 40 with the neck portion 13.

Since the cap and neck portion 13 are not rotatably pre-positioned before capping, the random position of the initial point of thread engagement will allow due to the multiple thread lead-ins a priority sealing placement of the cap 28 each and every time it is so positioned.

Referring back to FIGS. 1 and 2 of the drawings, it will be seen that the relative height of the cap's tear strip 42 indicated at TH is less than that of the given height of said opposing pairs of vertical fastening configurations 12B and 12E on the neck portion 11 at NH as indicated in FIG. 1 of the drawings. This inconsistency of registering heights between TH and NH defines a vertical space below the bottom of the tear strip 42 at 46 that provides additional visual evidence that the cap has not been tampered with.

The inclusion of spaced ratchet teeth 44 that are in a reversed annular direction to adjacent ratchet teeth 43 groups assure that the cap 29 cannot be effectively rotated on the neck portion 13 in any direction due to the engagement with the vertical fastening configurations 12 which are comprised of the four groups of alternating ratchet teeth 12B–E as hereinbefore described.

This arrangement of reverse registering ratchet teeth requires that the tear strip 42 of the cap 28 be removed first before the cap can be removed by selective rotation.

In order that the tear strip 42 be freed from the remainder of the cap defined by the annular depending wall 30 a pull tab 47 is freed at a vertical tear line 48 when moved outwardly as indicated by the broken lines in FIG. 4 of the drawings. The remaining interconnected portion of the tear skirt 42 is removed completely from the remaining cap portion on the neck 11 by breaking away each of the connecting members 45 which extend from selected ratchet teeth on the tear skirt 42 to the lower edge of the out-turned rib 32 as hereinbefore described. Each of the connecting members 45 is frangible at the lower edge of the out-turned rib 32 so that a relatively clean cap remaining portion defined by the downturned wall 30 is left on the neck portion 13 for typical rotation and selective removal and replacement.

Referring back to FIGS. 1 and 2 of the drawings, it will be seen that the neck 11 has annularly spaced segmented areas of increased arcuate dimension below the vertical fastening configurations 12 that define at least four areas 49,50,51, and 52 thereabout that conform an annular relationship to said hereinbefore described multiple ratchet teeth groups 12B–12E. Additionally, it should be noted that the opposing ratchet teeth groups 12D and 12E are of a lesser arcuate diameter than said adjacent opposing ratchet teeth groups 12B and 12C that as noted are of a reverse annular ratchet teeth direction. This combination of cap and neck ratchet teeth registration along with the registering of the annular inturned flange 40 with the neck bead 41 and an angular inturned neck finish flange 53 defines and imparts a novel improvement to a seven lead in thread cap and neck finish. This provides for a self-aligning multiple sealing non-initial rotational closure that results in an unusual and novel improvement combination for a push on pull off tamper evident cap.

It will thus be seen that an improvement to a push on pull off tamper indicating flexible cap and neck configuration has been illustrated and described and that various changes and modifications may be made therein without departing from the spirit of the invention, therefore I claim:

1. In combination, a container and a closure therefor, said container having a cylindrical neck surrounding an opening therein, said neck having a first neck portion of a first diameter, a plurality of external teeth on said first neck portion, a second neck portion of a second diameter less than said first diameter above said first neck portion, at least seven circumferentially and vertically spaced annular first spiral thread configurations on said second neck portion, each of said first spiral thread configurations extending in a helical path of continuous pitch around said second neck portion, each of said first spiral thread configurations having an upper end and a lower end, said lower end being circumferentially and axially spaced from said upper end, with the upper ends of each of said first spiral thread configurations forming circumferentially spaced lead-in points for the reception of said closure, each of said first spiral thread configurations having an arcuate extent around said second neck portion so that a vertical line drawn through said second neck portion at said upper ends intersects a plurality of said first spiral thread configurations, said closure having a top, an annular depending wall depending from said top, and at least seven circumferentially and vertically spaced annular second spiral thread configurations extending in a helical path of continuous pitch on the inner surface of said annular depending wall, a tear skirt positioned radially outwardly of said annular depending wall and frangibly joined thereto, and a plurality of internal teeth on said second neck portion, said second spiral thread configurations being engageable with said first spiral thread configurations and said internal teeth being engageable with said external teeth independent of the initial orientation of said closure relative to said neck, said second spiral thread configurations engaging said first spiral thread configurations and said internal teeth engaging said external teeth when said closure is substantially applied to said neck by pushing said closure onto said neck.

2. The combination of claim 1 wherein said second spiral thread configurations each have an arcuate extent around said annular depending wall so that a vertical line drawn through said second neck portion at said upper ends intersects at least five spiral thread configurations.

3. The combination of claim 1 wherein said second spiral thread configurations each have an arcuate extent around said annular depending wall so that a plane defined by the central axis of said closure and an upper end of at least one of said second spiral thread configurations intersects at least four other second spiral thread configurations.

4. The combination of claim 1 wherein said first spiral thread configurations each have a total arcuate extent of 180° to a complete spiral circle around said cylindrical neck portion.

5. The combination of claim 1 wherein said second spiral thread configurations each have a total arcuate extent of 180° to a complete spiral circle around said annular depending wall.

6. The combination of claim 1 wherein said second spiral thread configurations cumulatively define multiple turns of thread configurations on said upper skirt portion, and said closure has a sealing flange having a lower edge positioned below at least one of said multiple turns of thread configurations such that when said closure is applied to said neck, said sealing flange is in sealing engagement with said neck independent of the orientation of said closure relative to said neck.

7. A closure for a container of the type having a neck surrounding an opening therein, a first neck portion of a first diameter, a plurality of external teeth on the exterior of said first neck portion, a cylindrical neck portion of a second diameter less than said first diameter extending upwardly from said first neck portion, at least seven circumferentially and vertically spaced first spiral thread configurations extending in a helical path of continuous pitch around said cylindrical neck portion, each of said first spiral thread configurations having uppermost ends defining circumferentially spaced lead in points so as to form multiple means for registering engagement with said closure, said closure having a top, an annular wall depending from said top and having an outer diameter, at least seven circumferentially and vertically spaced second spiral thread configurations, said second spiral thread configurations extending in a helical path of continuous pitch on the inner surface of said annular wall, each said second spiral thread configuration having a first end and a second end, said second end circumferentially and axially spaced from said first end, said second spiral thread configurations each having an arcuate extent around said annular wall so that a plane defined by the central axis of said closure and said upper end of at least one of said second spiral thread configurations intersects a plurality of second spiral thread configurations, a tear skirt depending from said annular wall, said tear skirt having an inner diameter greater than said outer diameter of said annular wall, and a plurality of internal teeth on said tear skirt, said second spiral thread configurations being engageable with said first spiral thread configurations and said internal teeth being engageable with said external teeth when said closure is applied to said neck independent of the initial orientation of said closure relative to said neck, said second spiral thread configurations engaging said first spiral thread configurations and said internal teeth engaging said external teeth when said closure is substantially applied to said neck by pushing said closure onto said neck.

8. The closure of claim 7 wherein said second spiral thread configurations each have an arcuate extent around said annular depending wall so that a plane defined by the central axis of said closure and said upper end of at least one of said second spiral thread configurations intersects at least four other second spiral thread configurations.

9. The closure of claim 7 wherein said second spiral thread configurations each have a total arcuate extent of 180° to a complete spiral circle around said annular wall.

10. The closure of claim 7 wherein said second spiral thread configurations cumulatively define multiple turns of thread configurations on said upper skirt portion, and said closure has a sealing flange having a lower edge positioned below at least one of said multiple turns of thread configurations such that when said closure is applied to said neck, said sealing flange is in sealing engagement with said neck independent of the orientation of said closure relative to said neck.

11. A container having a neck surrounding an opening therein, said neck having a first neck portion of a first diameter, a plurality of external teeth on the exterior of said first neck portion, a cylindrical neck portion of a second diameter less than said first diameter, said cylindrical neck portion extending upwardly from said first neck portion, at least seven circumferentially and vertically spaced first spiral thread configurations extending in a helical path of continuous pitch around said cylindrical neck portion, where said first spiral thread configurations each have an arcuate extent around said cylindrical neck portion so that a plane defined by the central axis of said neck and said upper end of at least one of said first spiral thread configurations intersects a plurality of first spiral thread configurations, each of said first spiral thread configurations having uppermost ends defining circumferentially spaced lead in points so as to form multiple means for registering engagement with a flexible closure of the type having a depending annular wall and at least seven circumferentially and vertically spaced second spiral thread configurations extending in a helical path of continuous pitch on the inner surface of said depending annular wall of said closure, each said second spiral thread configuration having a first end and a second end, said second end circumferentially and axially spaced from said first end, a tear skirt depending from and positioned radially outwardly of said depending annular wall, and a plurality of internal teeth on said tear skirt, said first spiral thread configurations on said neck being engageable with said second spiral thread configurations on said closure and said external teeth on said neck being engageable with said internal teeth on said closure independent of the initial orientation of said closure relative to said neck, said second spiral thread configurations engaging said first spiral thread configurations and said external teeth engaging said internal teeth when said closure is substantially applied to said neck by pushing said closure onto said neck.

12. The container of claim 11 wherein said first spiral thread configurations each have an arcuate extent around said cylindrical neck portion so that a plane defined by the central axis of said neck and said upper end of at least one of said first spiral thread configurations intersects at least four other first spiral thread configurations.

13. The container of claim 11 wherein said spiral thread configurations each have a total arcuate extent of 180° to a complete spiral circle around said cylindrical neck portion.

* * * * *

UNITED STATES PATENT AND TRADEMARK OFFICE

CERTIFICATE OF CORRECTION

PATENT NO. : 5,690,243

DATED : November 25, 1997

INVENTOR(S) : Luca Molinaro

It is certified that error appears in the above-indentified patent and that said Letters Patent is hereby corrected as shown below:

In the Claims:

Claim 1, column 5, line 28, "second neck portion" should read --tear skirt--.

Signed and Sealed this

Eighth Day of December, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,690,243
DATED : November 25, 1997
INVENTOR(S) : Luca Molinaro

It is certified that error appears in the above-identified patent and that said Letters Patent is hereby corrected as shown below:

Title page,
Item [57], ABSTRACT,
Line 1, change "pull off" to -- twist off --.

Column 2,
Line 16, change "pull off" to -- twist off --.

Column 4,
Line 58, change "pull off" to -- twist off --.

Column 5,
Line 38, change "second" to -- first --.
Line 40, change "annular depending wall" to -- second neck portion --.

Column 6,
Line 22, change "upper" to -- first --.
Line 42, change "upper" to -- first --.

Column 7,
Line 1, change "said upper end" to -- an upper end --.

Signed and Sealed this

Thirtieth Day of July, 2002

*Attest:*

*Attesting Officer*

JAMES E. ROGAN
*Director of the United States Patent and Trademark Office*